US005842938A

United States Patent [19]

Garber

[11] Patent Number: 5,842,938

[45] Date of Patent: Dec. 1, 1998

[54] SWING TRAINING ASSEMBLY

[76] Inventor: Nicholas R. Garber, 2117 First Ave. SW., Minot, N. Dak. 58701

[21] Appl. No.: 837,789

[22] Filed: Apr. 22, 1997

[51] Int. Cl.[6] ..... A63B 69/00

[52] U.S. Cl. ..... 473/430; 473/418

[58] Field of Search ..... 473/423–430, 473/418, 419, 451, 213, 197, 160, 108

[56] References Cited

U.S. PATENT DOCUMENTS

| | | | |
|---|---|---|---|
| 3,042,401 | 7/1962 | Denegre | 473/430 |
| 3,397,885 | 8/1968 | Nash, Jr. | 473/418 |
| 3,529,823 | 9/1970 | Garver | 473/418 |
| 3,658,330 | 4/1972 | Maestracci et al. | 473/429 |
| 3,731,926 | 5/1973 | Vincent | 473/429 |
| 3,907,287 | 9/1975 | Fox et al. | 473/424 |
| 3,924,855 | 12/1975 | Pretorius | 473/430 |
| 4,216,960 | 8/1980 | Nicholls | 473/430 |
| 4,521,016 | 6/1985 | Tominaga | 473/430 |
| 5,098,094 | 3/1992 | Kita | 473/423 |
| 5,282,615 | 2/1994 | Green et al. | 473/418 |
| 5,374,056 | 12/1994 | Scher et al. | 473/418 |
| 5,386,989 | 2/1995 | Broadway | 273/29 |
| 5,460,364 | 10/1995 | Ring | 273/26 |
| 5,540,430 | 7/1996 | Nichols et al. | 473/418 |
| 5,611,539 | 3/1997 | Watterson et al. | 473/430 |
| 5,681,168 | 10/1997 | Brown | 473/423 |
| 5,738,599 | 4/1998 | Malwitz | 473/423 |
| 5,743,820 | 4/1998 | Espinosa et al. | 473/429 |

OTHER PUBLICATIONS

Sportime Magazine, 1996 Summer Edition, pp. 8–11 and 136–137.

Sportime Magazine, 1997 Summer Edition, p. E.

Flaghouse Magazine, Spring 1996, pp. 85 and 114.

*Primary Examiner*—Mark S. Graham

*Attorney, Agent, or Firm*—James L. Johnson

[57] ABSTRACT

A number of swing training assemblies are disclosed. One of the assemblies is for use in a gymnasium and includes a main support member or rope which extends between the two basketball rims and is detachably interconnected therewith. A plurality of ball suspension members or ropes are spaced along the main support member or rope and extend downwardly therefrom. A ball is detachably connected to each of the ball suspension members.

18 Claims, 5 Drawing Sheets

SWING TRAINING ASSEMBLY

FIELD OF THE INVENTION

The present invention relates to a swing training assembly and, more specifically, to a swing training assembly which allows a player to swing at a moving ball with a bat.

BACKGROUND OF THE INVENTION

Many devices are available in sporting applications to develop or perfect the requisite swing. In baseball, a common "swing training device" is a batting tee which allows the player to swing at a stationary ball. This type of device is typically used by players 6 years of age or younger. Although a batting tee develops a player's hand-eye coordination, it is inadequate in that it does not prepare the player to hit a moving target or prepare the player for "coach pitch" or "kid pitch."

Development of a player's swing is typically undertaken on a one-on-one basis with an appropriate coach. However, in some cases it is desirable for a number of players to be able to "practice" their swings simultaneously or in a group. This is reasonably possible in golf where a single coach can monitor a plurality of players at a driving range which has a plurality of stations. It is more expensive for a plurality of baseball players to simultaneously work on their swings against "live" pitching since this requires a plurality of batting machines.

SUMMARY OF THE INVENTION

The present invention generally relates to a swing training assembly. A first aspect of the present invention presents multiple stations to accommodate multiple users, such as for use in a physical education class. A first support member (e.g., rope, cable, a rigid structure) is interconnectable with two elevation-generating members which are laterally displaced and which thereby dispose the first support member above the ground or the surface on which the participants will stand when using the swing training assembly. For example, the two laterally displaced elevation-generating members could be the basketball rims on a basketball court in a gymnasium, a frame of some sort, or simply a pair of generally vertically extending posts. A plurality of training stations are laterally spaced along the length of the first support member and each includes a second support member (e.g., rope, cable) which extends down from the first support member when attached to the elevation-generating members, as well as a ball which is interconnected with the second support member. This suspends the balls from the first support member and above the ground or support surface at a plurality of spaced locations to allow a plurality of participants to use the swing training assembly.

Various additional features may be incorporated into the above-noted first aspect, both singularly and in any combination. The first support member may be simply a piece of rope or cable which would allow the first support member to be rolled up after use for convenient space-reduced storage. Other types of materials could be used for the first support member as well, such as those which are generally rigid (e.g., PVC tubing, wood, metal). Connectors may be provided on each end of the first support member to allow the first support member to be attached to the two laterally spaced elevation-generating members, and to thereafter allow the first support member to be removed from these elevation-generating members after use (e.g., the first support member may be detachably interconnectable with the elevation-generating members). The location where the plurality of second support members extend downwardly from the first support member may be fixed, such as by disposing a plurality of hooks along the first support member, or may be adjustable by disposing each second support member between a pair of positioning members which are movable along the first support member and which may thereafter be disposed in fixed relation thereto.

Each second support member of the above-noted first aspect may be a piece of rope, cable, or other similar material. The length of the second support member, or the distance which the second support member extends downwardly from the first support member, may be adjustable to accommodate users of various heights. Each second support member may also include some type of connector to allow each second support member to be attached to the first support member for use of the swing training assembly, and to thereafter be removed from the first support member after use (e.g., each second support member may be detachably interconnectable with the first support member).

The ball provided for each second support member may be a hollow structure with at least one hole having a first effective diameter, and is preferably a perforated plastic ball (e.g., a plastic round shell with a plurality of perforations therein). A ball connector provided for each second support member may have a second effective diameter which exceeds the first effective diameter of the at least one hole. As such, when the ball connector is disposed within the interior of the ball through the noted hole, the ball is interconnected with the second support member. The ball connector may be formed of a pliable material, and furthermore the ball connector may be configured such that when its corresponding ball is hit with a bat, the ball connector will be pulled out from the interior of the ball to allow the ball to detach from the second connector. In one embodiment each ball is a plastic, round, hollow ball with a plurality of perforations therein, and each ball connector is a small suction cup (e.g., the type of suction cup found on darts from children's dart guns or on arrows from children's bow and arrow sets).

A second aspect of the present invention includes an elevation-generating system with a first member which has a lateral extent and which is disposed above the ground or the surface on which the participant of the swing training assembly will stand. A second member (e.g., rope, cable, pliable tubing) is interconnected with the elevation-generating assembly (e.g., fixedly, detachably) and extends generally downwardly from the first member. A ball is detachably connected with the interconnecting member by a ball connector which is disposed inside the ball and which is removable from the interior of the ball when the ball is struck with a bat.

Various additional features may be incorporated into the above-noted second aspect, both singularly and in any combination. For instance, the elevation-generating assembly of this second aspect may include one or more of the attributes of the pair of elevation-generating members and the first support member of the first aspect discussed above. The elevation-generating assembly may also be a frame for a single user which extends generally upwardly from the ground a certain distance, and which also extends generally laterally (e.g., parallel with the ground). The second member of this second aspect may include one or more of those attributes of the second support member of the first aspect discussed above. Finally, the ball and/or ball connector of this second aspect may include one or more of those attributes of the ball and/or ball connector from the first aspect discussed above.

DETAILED DESCRIPTION

Figure 1:
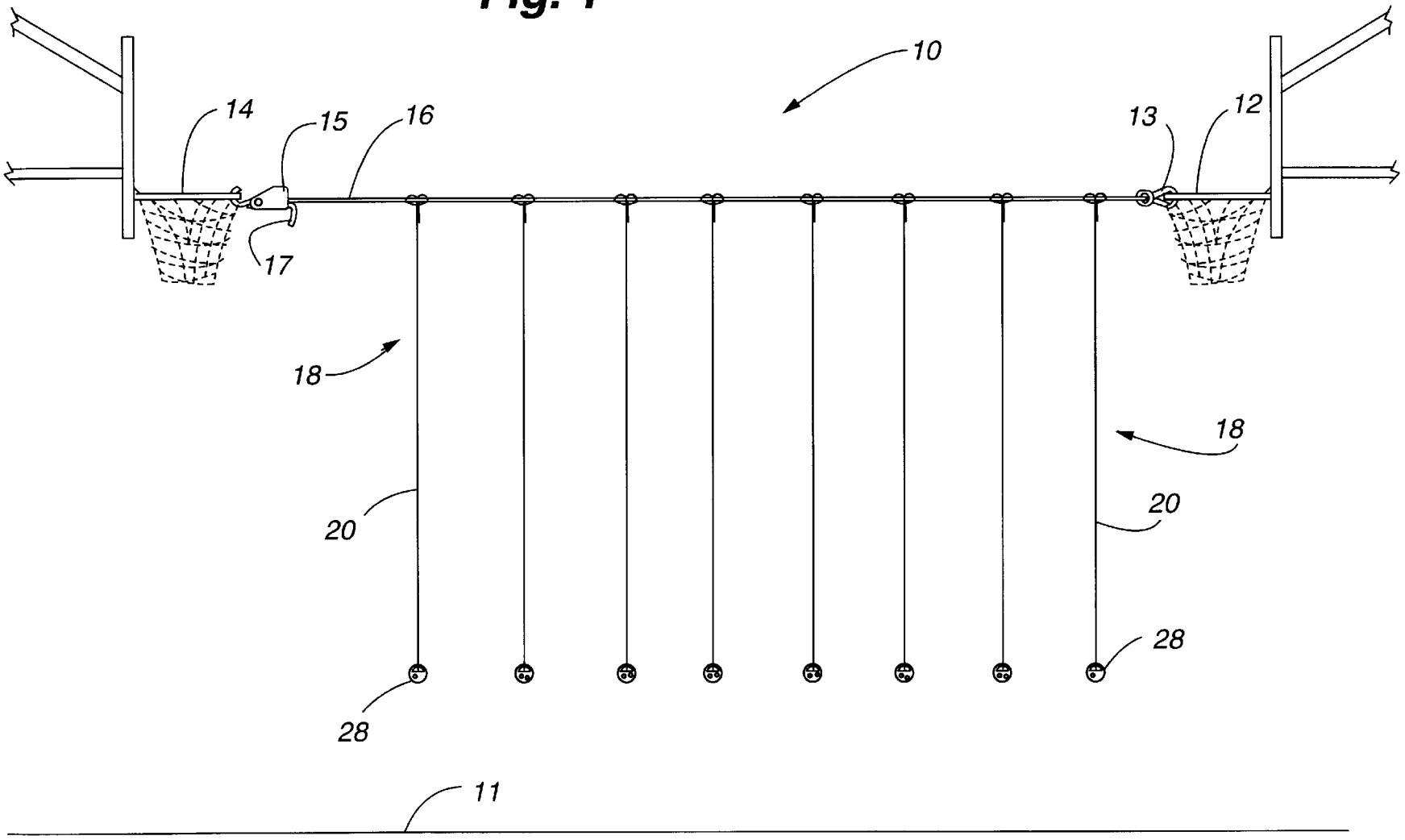
FIG. 1 is a side view of one embodiment of a swing training assembly in accordance with principles of the present invention.
Figure 1B:
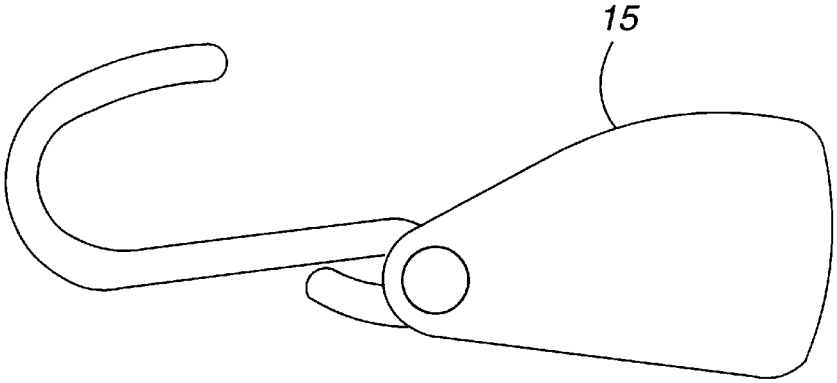
FIG. 1B is an enlarged view of another embodiment of a detachable connector for the main mounting member illustrated in FIG. 1 and which provides tensioning capabilities for the main mounting member.
Figure 1A:
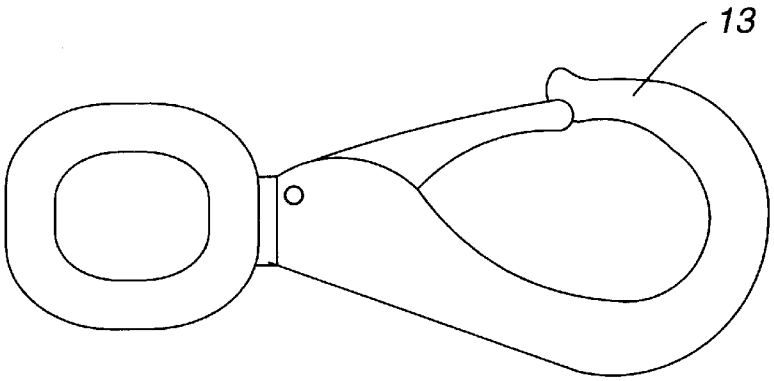
FIG. 1A is an enlarged view of one embodiment of a detachable connector for the main mounting member illustrated in FIG. 1.

The present invention will be described in relation to the accompanying drawings which assist in illustrating its various features. A swing training assembly 10 is illustrated in FIG. 1. The swing training assembly 10 includes a first support 12 and a laterally displaced second support 14 which in the illustrated embodiment are basketball rims disposed above the gym floor 11 (i.e., the first support 12 and second support 14 are elevation-generating members). A main mounting member 16 (e.g., rope, cable, a cord-like material, flexible tubing, a rigid support) is strung between and detachably interconnected with each of these first and second supports 12, 14. In the preferred embodiment the main mounting member 16 is a piece of rope. One end of the main mounting member 16 is interconnected to the first support 12. Preferably, the main mounting member 16 is detachably interconnected with the first support 12, such as by a first connector 13 which is illustrated in more detail in FIG. 1A and which in one embodiment is a snap swivel hook. The opposite end of the main mounting member 16 is interconnected with a second support 14. Preferably, the main mounting member 16 is detachably interconnected with the second support 14, such as by interfacing with a second connector 15 which detachably interconnects the main mounting member 16 with the second support 14. The second connector 15 in one embodiment is a rope ratchet which allows a free end 17 of the main support member 16 to be fed through a ratchet assembly within the second connector 15. This allows the free end 17 of the main support member 16 to be pulled upon to tension the main support member 16, and this tension is maintained by the ratchet assembly disposed within the second connector 15.

Figure 2C:
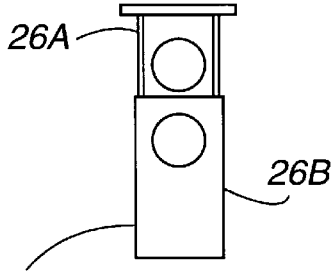
FIG. 2C is an enlarged view of the length adjusting device used in the training station of FIG. 2.
Figure 2A:
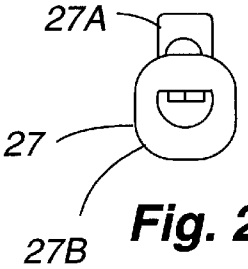
FIG. 2A is an enlarged view of one of the two training station positioners used for each of the training stations illustrated in FIGS. 1 and 2.

A plurality of laterally spaced training stations 18 are positioned along the main support member 16 to allow the swing training assembly 10 to be used by a plurality of participants. In one embodiment, the training stations 18 are spaced about 6'–8' from each other. One of the training stations 18 is illustrated in more detail in FIG. 2. Each training station 18 includes a ball suspension member 20 (e.g., rope, cable, a cord-like material, flexible tubing) which is preferably detachably interconnected with the main mounting member 16 by a swivel snap hook 24. A training station positioner 27 is disposed on each side of the swivel snap hook 24 to maintain the position of each training station 18 along the main support member 16 during use (e.g., a fixed position relative to the main support member 16). In one embodiment, each of the training station positioners 27 is what is commonly referred to as a cord lock which is illustrated in more detail in FIG. 2A. This type of training station positioner 27 includes a first member 27A which is slidably interconnected with a second member 27B and which is biased away therefrom by a spring (not shown). The first member 27A is moved toward the second member 27B to align their respective holes through which the main support member 16 is then threaded. When the first member 27A is released, it moves away from the second member 27B by the action of the biasing spring to bind the training station positioner 27 at a fixed point on the main support member 16 (i.e., by moving their respective holes out of alignment). These types of training station positioners 27 allow the distance between training stations 18 to be adjusted and/or facilitate disassembly/storage of the swing training assembly 10. Although a detachable interconnection of each of the training stations 18 is preferred as noted, in another embodiment each training station 18 is fixedly interconnected with the main support member 16 (not shown).

Figure 2B:
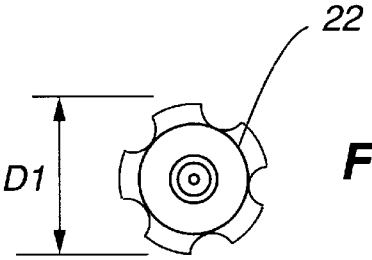
FIG. 2B is an enlarged top view of the ball connector used in the training station of FIG. 2.
Figure 2:
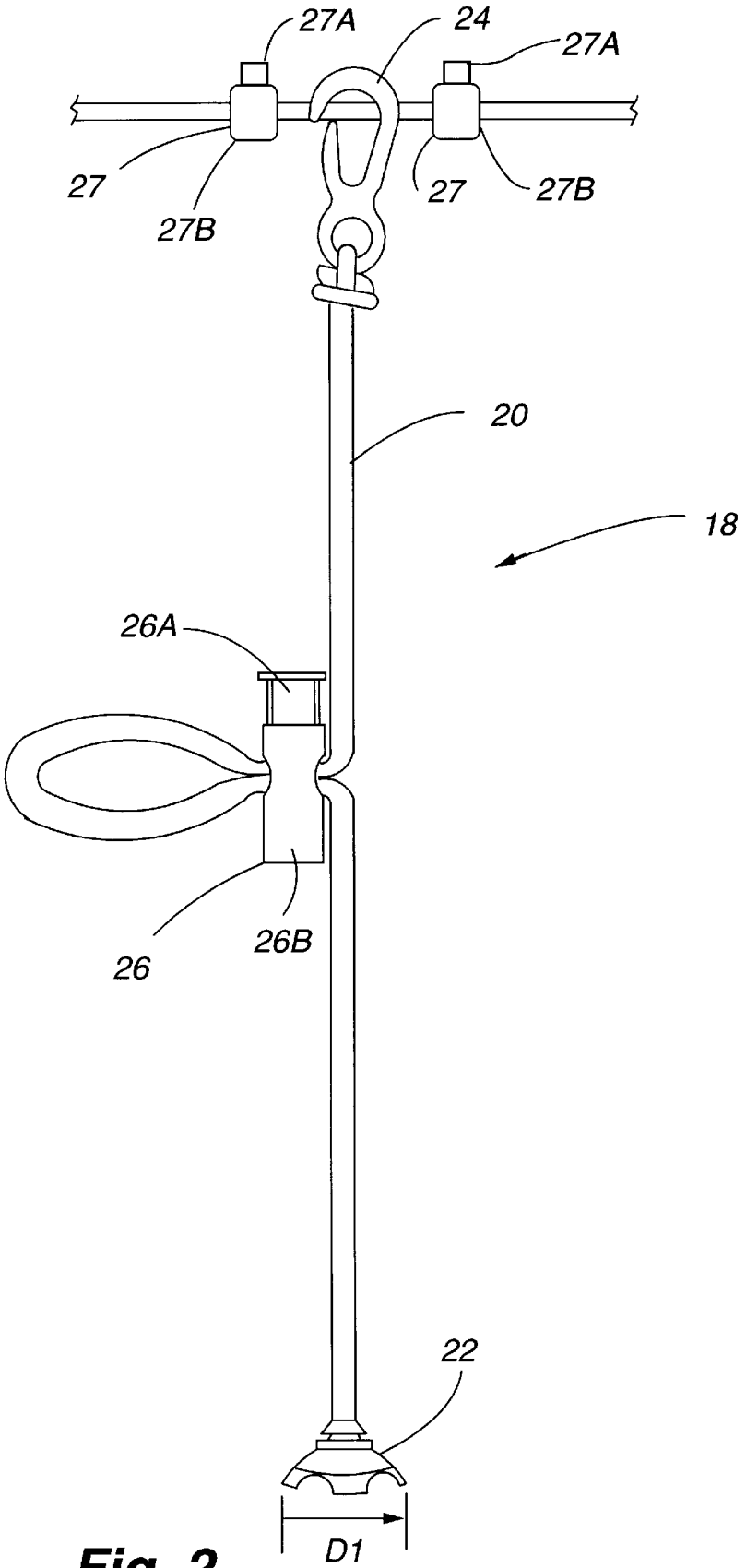
FIG. 2 is an enlarged view of one of the plurality of training stations illustrated in FIG. 1.
Figures 3A, 3B, 3C:
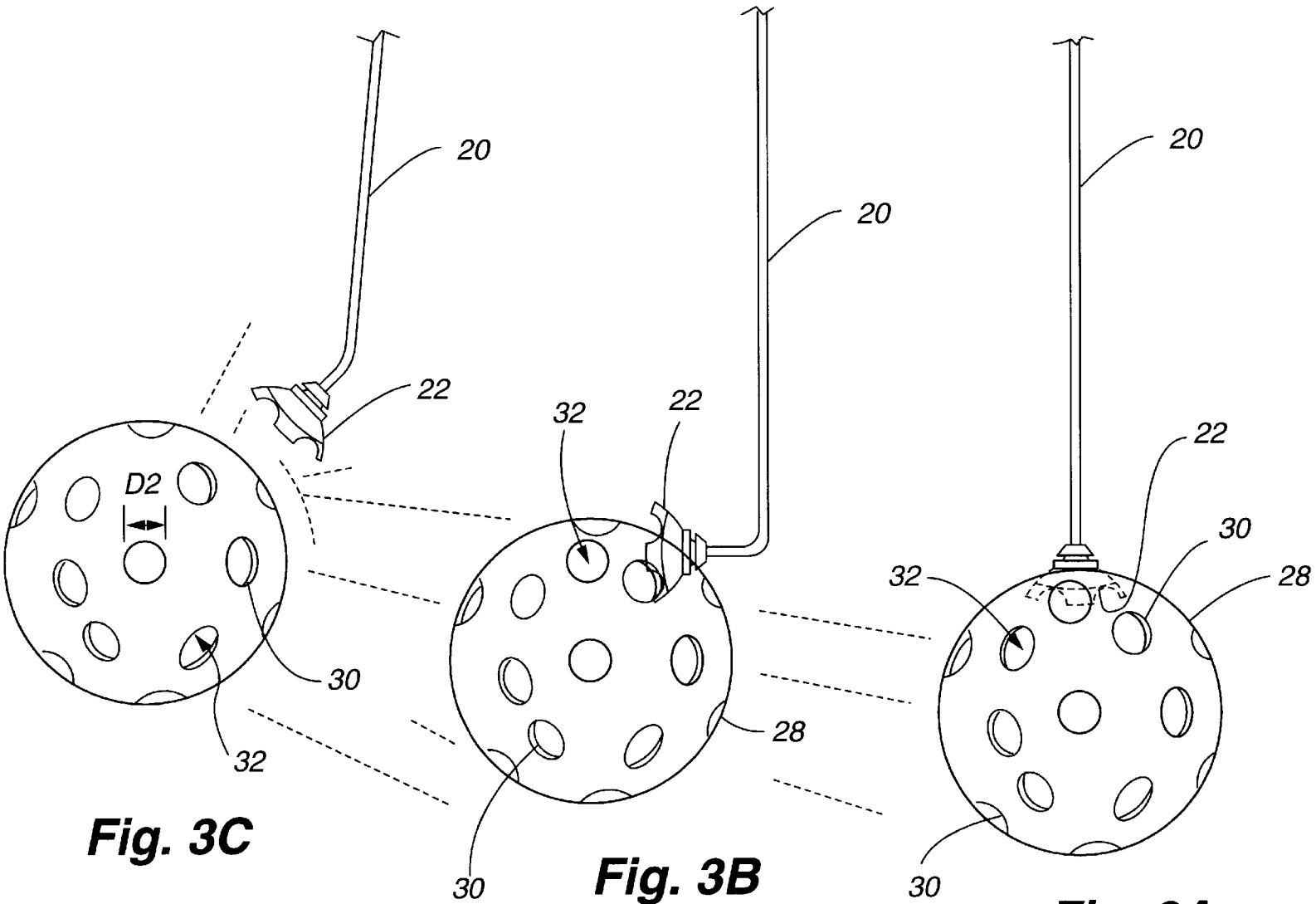
FIG. 3A–C are sequential views illustrating the release of the ball from one of the training stations illustrated in FIG. 1.

A suction cup 22 is disposed on the end of the ball suspension member 20 and serves to detachably interconnect the suspension member 20 with a ball 28 (FIGS. 1 and 3). In one embodiment, the suction cup 22 is formed from a pliable or flexible material (e.g., rubber, vinyl) and has an effective outer diameter $D_1$ as illustrated in FIG. 2B. The ball 28 has a hollow outer shell, a hollow interior 32, and a plurality of holes 30 through the hollow shell of the ball 28 with at least one of these holes 32, and typically all of these holes 32, having a diameter $D_2$ which is smaller than the effective outer diameter $D_1$ of the suction cup 22. As such, the suction cup 22 may be collapsed and disposed through one of the holes 30 in the ball 28 (see FIGS. 3A–C) to detachably interconnect the ball suspension member 20 with the ball 28. In order to accommodate for different heights of participants, each training station 18 also preferably includes a length adjusting device 26 to allow the distance with the ball 28 is disposed above the floor 11 to be adjusted. In one embodiment this length adjusting device 26 is what is commonly referred to as a cord lock which is illustrated in more detail in FIG. 2C. This type of length adjusting device 26 includes a first member 26A which is slidably interconnected with a second member 26A and which is biased away therefrom by a spring (not shown). The first member 26A is moved toward the second member 26B to align their respective holes through which the ball suspension member 20 is threaded in the manner illustrated in FIG. 2 (e.g., forming a loop). When the first member 26A is released, it moves away from the second member 26B by the action of the biasing spring to fix the length of the ball suspension member 22 (i.e., by moving their respective holes out of alignment). Although this length adjustment feature is preferred, in another embodiment the length of the ball suspension member 22 is fixed (i.e., not adjustable).

Each training station 18 allows the ball suspension member 20 to be swung to allow the ball 28 to be moving when struck with a bat by the participant. Alternatively, the ball suspension member 20 may remain in a stationary position for those less skilled. Moreover, each training station 18 allows the ball 28 to be released therefrom when struck with the bat, and this is illustrated in FIGS. 3A–C. Referring first to FIG. 3A, the suction cup 22 is disposed within the interior 32 of the ball 28 after having passed through one of its holes 30, along with the ball suspension member 20. With the effective outer diameter of the suction cup 22 $D_1$ being larger than the diameter $D_2$ of the holes 30 in the ball 28, the ball 28 remains attached to the end of the ball suspension member 20 and suspended above the ground 11 (FIG. 1). The height which the ball 28 is disposed above the ground 11 may be adjusted to fit the height of the participant through the length adjusting device 26 as noted above (FIGS. 2 and 2C). When the participant strikes the ball 28 with a bat, the resulting forces exerted on ball 28 and then the suction cup 22 cause the suction cup 22 to deform and it begins to be pulled out from the interior 32 of the ball 28 through the hole 30 as illustrated in FIGS. 3B. The suction cup 22 will then pull completely through the hole 30 to allow the ball 28 to allow the ball 28 to continue on a path which is unimpeded by the ball suspension member 20 as illustrated in FIG. 3C. That is, the ball 28 totally separates from the ball suspension member 20. The ball 28 may then be retrieved and reinstalled on the end of the ball suspension member 20 by collapsing the suction cup 22 and passing the suction cup 22 through one of the holes 30 in the ball 28.

Figure 4:
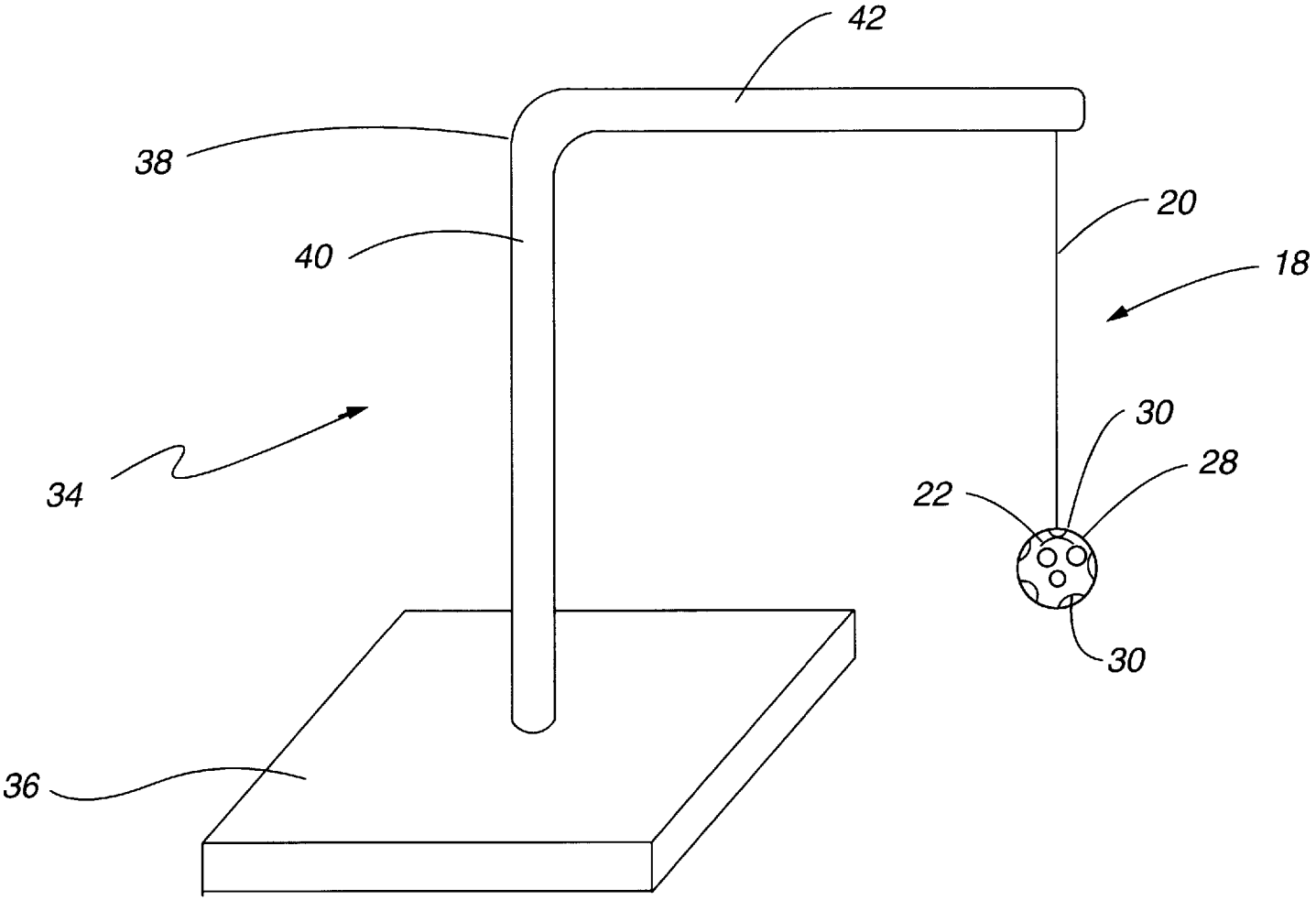
FIG. 4 is another embodiment of a swing training assembly.

Another embodiment of a swing training assembly is illustrated in FIG. 4. The swing training assembly 34 is for a single user and includes an appropriately sized/weighted base 36 with a frame 38 attached thereto. Preferably, the frame 38 detachably interfaces with the base 36 (e.g, via a threaded interconnection (not shown)). The frame 38 includes a first member 40 which extends generally upwardly from the base 36 and a second member 42 which extends generally horizontally or laterally from the first member 40. To facilitate storage, the first member 40 and second member 42 may be detachably interconnectable as well (e.g., via a press fit or threaded interconnection). A single training station 18 is interconnected with the second member 42. That is, a ball suspension member 20 extends down from the second member 42, and a ball connector or suction cup 22 detachably interconnects the ball suspension member 20 with the ball 28 in the above-noted manner. Although not shown, a length adjusting device 26 could be utilized. Moreover, the ball suspension member 22 can be fixedly connected or detachably interconnected with the frame 38.

The foregoing description of the present invention has been presented for purposes of illustration and description. Furthermore, the description is not intended to limit the invention to the form disclosed herein. Consequently, variations and modifications commensurate with the above teachings, and skill and knowledge of the relevant art, are within the scope of the present invention. The embodiments described hereinabove are further intended to explain best modes known of practicing the invention and to enable others skilled in the art to utilize the invention in such, or other embodiments and with various modifications required by the particular application(s) or use(s) of the present invention. It is intended that the appended claims be construed to include alternative embodiments to the extent permitted by the prior art.

What is claimed is:

1. A swing training assembly, comprising:

a first support member adapted to be interconnectable with first and second generally vertically extending and laterally spaced supports, said first support member being generally laterally extending when connected to said first and second supports;

a plurality of laterally spaced training stations, each said station comprising a second support member extending generally downwardly from said first support member when connected to said first and second spaced supports and a ball interconnected with said second support member, whereby said ball is suspended below said first support member.

2. An assembly, as claimed in claim 1, wherein:

said first support member comprises a rope.

3. An assembly, as claimed in claim 1, wherein:

said first support member comprises first and second ends and first and second connectors associated with said first and second ends, said first and second connectors being detachably connectable with said first and second supports, respectively.

4. An assembly, as claimed in claim 1, wherein:

each said second support member comprises rope.

5. An assembly, as claimed in claim 1, wherein each said training station further comprises:

means for adjusting a length of said second support member.

6. An assembly, as claimed in claim 1, wherein each said training station further comprises:

means for detachably connecting said ball and said second support member.

7. An assembly, as claimed in claim 1, wherein:

each said ball comprises a hollow structure with at least one hole having a first effective diameter, wherein each said training station further comprises a ball connector attached to said second member and having a second effective diameter greater than said first effective diameter, said second member extending through said at least one hole in said ball and said ball connector being disposed within an interior of said ball.

8. An assembly, as claimed in claim 7, wherein:

said ball connector comprises a pliable material.

9. An assembly, as claimed in claim 7, wherein:

said ball connector is removable from said interior of said ball by being pulled through said at least one hole when said ball is struck with a bat.

10. An assembly, as claimed in claim 1, wherein:

said ball of each said training station comprises a whiffle ball.

11. A swing training assembly, comprising:

a frame comprising a first frame member having a lateral extent and disposed above a supporting surface for said frame;

a support member interconnected with said frame and extending downwardly from said first frame member;

a ball; and mean for detachably connecting said support member and said ball and comprising a ball connector disposed within an interior of said ball and which is removable from said interior of said ball when said ball is struck with a bat.

12. An assembly, as claimed in claim 11, wherein:

said support member comprises a cord-like member.

13. An assembly, as claimed in claim 11, wherein:

said support member comprises rope.

14. An assembly, as claimed in claim 11, wherein:

said ball comprises a hollow structure with at least one hole having a first effective diameter, wherein said ball connector has a second effective diameter greater than said first effective diameter, said second member extending through said at least one hole in said ball.

15. An assembly, as claimed in claim 14, wherein:

said ball connector is removable from said interior of said ball by being pulled through said at least one hole when said ball is struck with a bat.

16. An assembly, as claimed in claim 11, wherein:

said ball comprises a whiffle ball.

17. An assembly, as claimed in claim 11, wherein:

said ball connector comprises a suction cup.

18. An assembly, as claimed in claim 11, further comprising:

means for adjusting a length of said cord-like member to vary a distance of said ball above said supporting surface.

* * * * *